US009318842B2

(12) United States Patent
Tashiro et al.

(10) Patent No.: US 9,318,842 B2
(45) Date of Patent: Apr. 19, 2016

(54) CONNECTOR

(71) Applicant: YAZAKI CORPORATION, Minato-ku, Tokyo (JP)

(72) Inventors: Harunori Tashiro, Kakegawa (JP); Norio Sugiyama, Kakegawa (JP); Kengo Aoshima, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/396,629

(22) PCT Filed: Apr. 24, 2013

(86) PCT No.: PCT/JP2013/002759

§ 371 (c)(1),
(2) Date: Oct. 23, 2014

(87) PCT Pub. No.: WO2013/171982

PCT Pub. Date: Nov. 21, 2013

(65) Prior Publication Data

US 2015/0126057 A1 May 7, 2015

(30) Foreign Application Priority Data

May 16, 2012 (JP) ..... 2012-112289

(51) Int. Cl.
*H01R 13/42* (2006.01)
*H01R 13/62* (2006.01)
*H01R 13/422* (2006.01)
(Continued)

(52) U.S. Cl.
CPC ..... *H01R 13/62* (2013.01); *H01R 13/42* (2013.01); *H01R 13/4223* (2013.01); *H01R 13/4364* (2013.01); *H01R 24/68* (2013.01)

(58) Field of Classification Search
CPC ..... H01R 101/00; H01R 13/4362
USPC ..... 439/738, 752, 695, 589, 587
See application file for complete search history.

(56) References Cited

U.S. PATENT DOCUMENTS 5,520,553 A 5/1996 Cecil, Jr. et al.
2009/0191747 A1 7/2009 Tanaka et al.
(Continued)

FOREIGN PATENT DOCUMENTS

EP 0 716 473 A1 6/1996
EP 0 971 450 A1 1/2000
(Continued)

OTHER PUBLICATIONS

International Search Report of PCT/JP2013/002759, dated Jul. 30, 2013. [PCT/ISA/210].
(Continued)

*Primary Examiner* — Phuongchi T Nguyen
(74) *Attorney, Agent, or Firm* — Sughrue Mion, PLLC

(57) ABSTRACT

A connector (1) includes a housing (7) for housing a terminal (5) connected to an electric wire (3), and a front holder (11) attached to the housing (7), and configured to allow a connecting portion (9) of the terminal (5) to be exposed outside of the housing (7) and hold the terminal (5) in a regular position to prevent the terminal (5) from coming off the housing (7). The housing (7) includes a housing locking projection (15) provided in the housing (7) with an insertion space (13) to allow the terminal (5) to be inserted in the housing (7) and configured to lock the terminal (5) with the front holder (11) attached to the housing (7) to prevent the terminal (5) from coming off the housing (7) toward the electric wire (3).

2 Claims, 4 Drawing Sheets

(51) Int. Cl.
*H01R 13/436* (2006.01)
*H01R 24/68* (2011.01)

(56) References Cited

U.S. PATENT DOCUMENTS

| | | | | |
|---|---|---|---|---|
| 2011/0014822 | A1 | 1/2011 | Kato et al. | |
| 2012/0178310 | A1* | 7/2012 | Ekchian ..... | H01R 13/4538 439/692 |
| 2013/0171853 | A1 | 7/2013 | Tsujii et al. | |

FOREIGN PATENT DOCUMENTS

| | | | |
|---|---|---|---|
| EP | 0716473 | B1 | 4/2000 |
| EP | 0971450 | B1 | 10/2002 |
| JP | 8-148214 | A | 6/1996 |
| JP | 8-241749 | A | 9/1996 |
| JP | 2003-142195 | A | 5/2003 |
| JP | 2008-300330 | A | 12/2008 |
| JP | 2009-211976 | A | 9/2009 |
| WO | 2012/039254 | A1 | 3/2012 |

OTHER PUBLICATIONS

Communication dated Oct. 20, 2015 from the Japanese Patent Office in counterpart application No. 2012-112289.

Communication dated Dec. 30, 2015 from the State Intellectual Property Office of the P.R. China issued in corresponding Chinese Application No. 201380025747.6.

* cited by examiner

CONNECTOR

TECHNICAL FIELD

The present invention relates to a connector.

BACKGROUND ART

There is known a connector, as proposed in Patent Literature 1, including a housing which houses terminals connected to electric wires, in which the housing is provided with housing lances for locking the terminals so as to prevent the terminals from coming off the housing on the wire side.

Such a connector includes a front holder attached to the housing, in a manner such that connecting portions of the terminals are exposed on the outside of the housing, to prevent the terminals from coming off the housing.

CITATION LIST

Patent Literature

[PTL 1] Japanese Patent Unexamined Publication No. 2009-211976

SUMMARY OF INVENTION

However, in the connector described in Patent Literature 1, since the housing lances for preventing the terminals from coming off the housing on the wire side, are flexible, external force because of wire bending is concentrated on base portions of the flexible housing lances, which may, at worst, cause fractures at the base portions. If the housing lances are damaged, the terminals cannot be held securely in the housing.

It is an object of the present invention to provide a connector capable of improving retention stability of terminals in a housing.

A connector in accordance with some embodiments includes a housing for housing a terminal connected to an electric wire and a front holder attached to the housing, and configured to allow a connecting portion of the terminal to be exposed outside of the housing and hold the terminal in a regular position to prevent the terminal from coming off the housing. The housing includes a housing locking projection provided in the housing with an insertion space to allow the terminal to be inserted in the housing and configured to lock the terminal with the front holder attached to the housing to prevent the terminal from coming off the housing toward the electric wire.

According to the configuration described above, the housing is provided with the housing locking projections having the insertion spaces through which the terminals can be inserted in the housing. The housing locking projections lock and prevent the terminals from coming off the housing on the wire side in the state in which the front holder is attached to the housing. Due to such a configuration, the housing locking projections are not required to be flexible unlike lances and as a result, the resistance of the housing locking projections to external force can be improved.

Accordingly, the connector can significantly prevent damage to the housing locking projections by the external force, and thereby improve the retention stability of the terminals in the housing.

The front holder may include a holder locking projection located in a position opposed to the housing locking projection in a direction perpendicular to an extending direction of the electric wire, configured to be inserted in the insertion space when the front holder is attached to the housing with the terminal housed in the housing, and configured to lock the terminal with the front holder attached to the housing to prevent the terminal from coming off the housing toward the electric wire.

According to the configuration described above, the terminals are locked with the housing locking projections and the holder locking projections. Therefore, the terminals can surely be prevented from coming off the housing, so that the retention stability of the terminals in the housing can be further improved.

The housing locking projections and the holder locking projections are provided in a manner as to face each other in the direction perpendicular to the extending direction of the terminals. Therefore, even if the external force is applied to the terminals, at least one of the locking projections can lock the terminals.

The holder locking projections are inserted into the insertion spaces provided in the housing locking projections. Therefore, the holder locking projections are not required to be flexible unlike lances and as a result, the resistance of the holder locking projections to the external force can be improved.

The housing locking projection and the holder locking projection may be provided to be located in a same position in the extending direction of the electric wire and configured to engage with an engaging hole provided in the terminal.

According to the configuration described above, the housing locking projections and the holder locking projections are located in the same position in the extending direction of the terminals, and engage with the same engaging holes provided in the terminals. Therefore, the engaging holes of the terminals can be commonly used and therefore, the structure of the terminals can be simplified.

The housing locking projection may include a terminal guiding portion configured to guide the terminal to the insertion space, and the holder locking projection may include a holder guiding portion configured to guide the holder locking projection to the insertion space.

According to the configuration described above, the housing locking projections are provided with the terminal guiding portions for guiding the terminals to the insertion spaces, and the holder locking projections are provided with the holder guiding portions for guiding the holder locking projections to the insertion spaces. Therefore, the terminals can be easily locked with the housing locking projections and the holder locking projections at the point of attachment of the terminals and the front holder to the housing. As a result, the attachment performance can be improved.

Consequently, the connector capable of improving the retention stability of the terminals in the housing can be provided.

DESCRIPTION OF EMBODIMENTS

Figure 1:
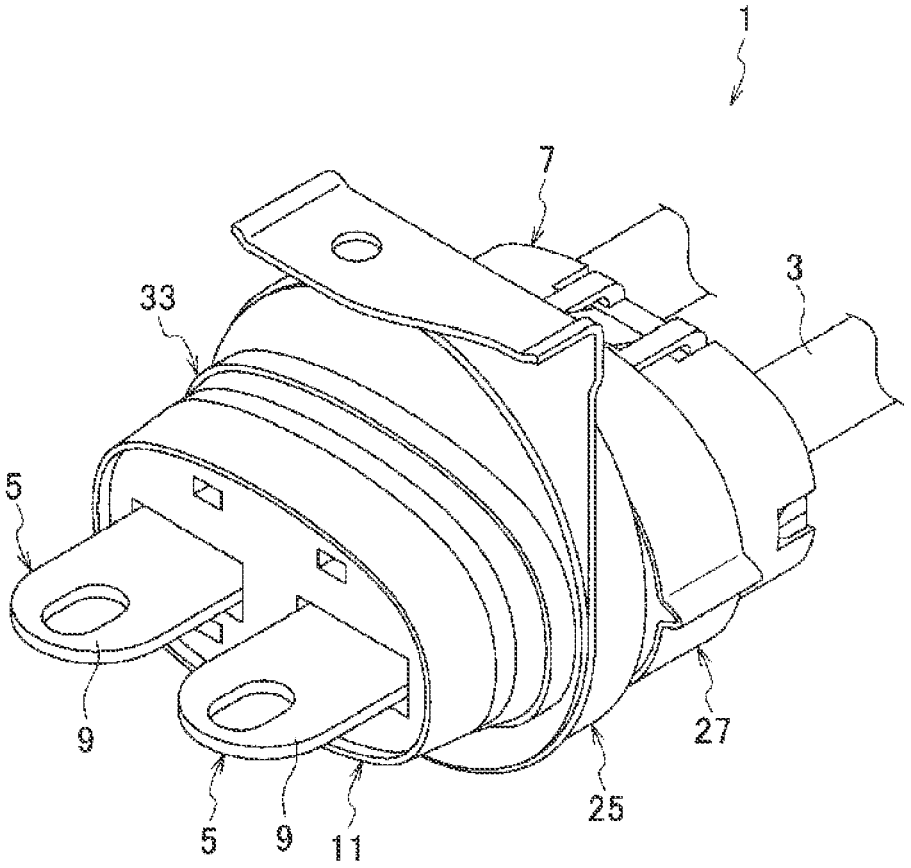
FIG. 1 is a perspective view of a connector according to an embodiment of the present invention.
Figure 2:
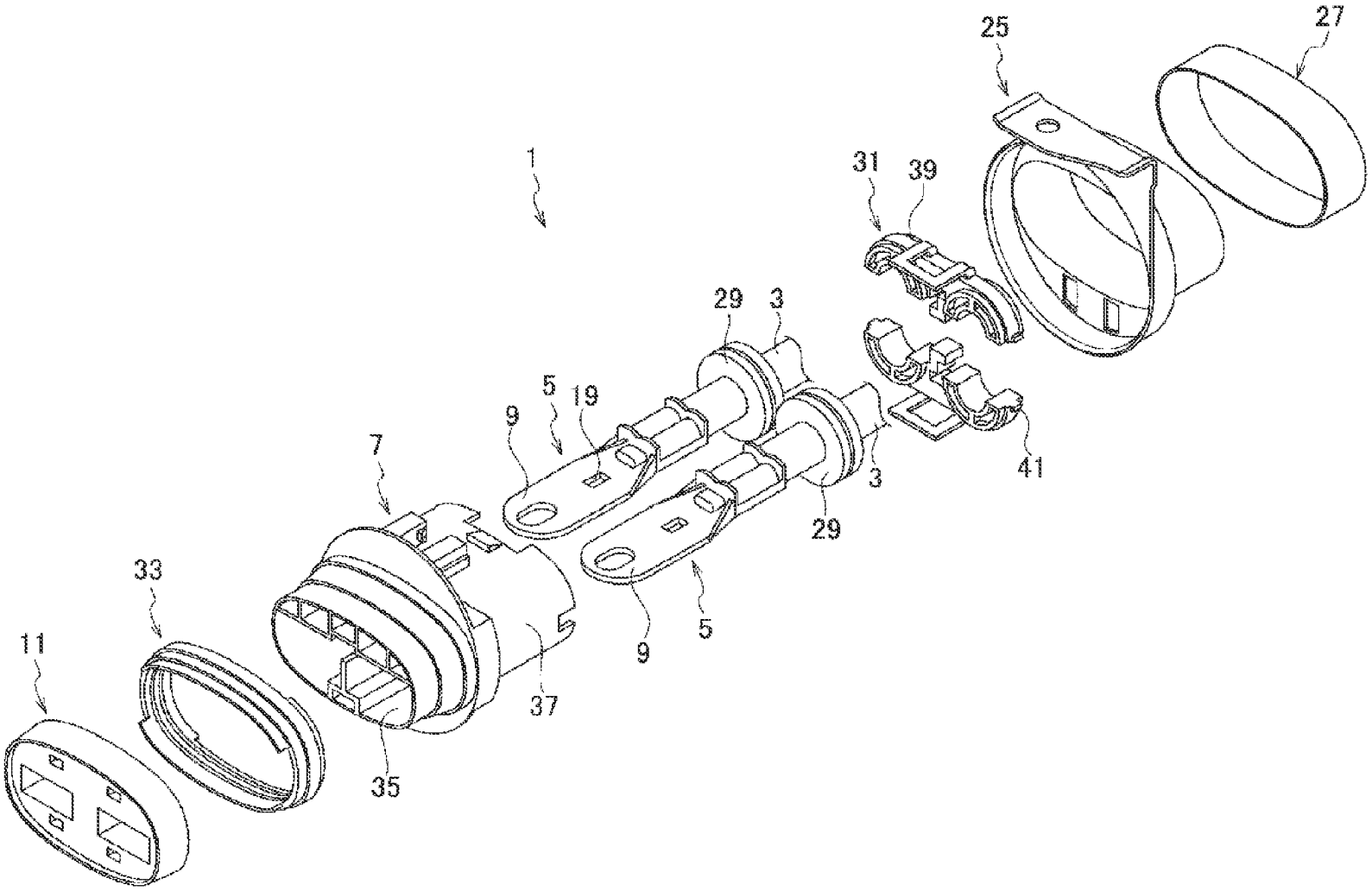
FIG. 2 is an exploded perspective view of the connector according to the embodiment of the present invention.
Figure 3:
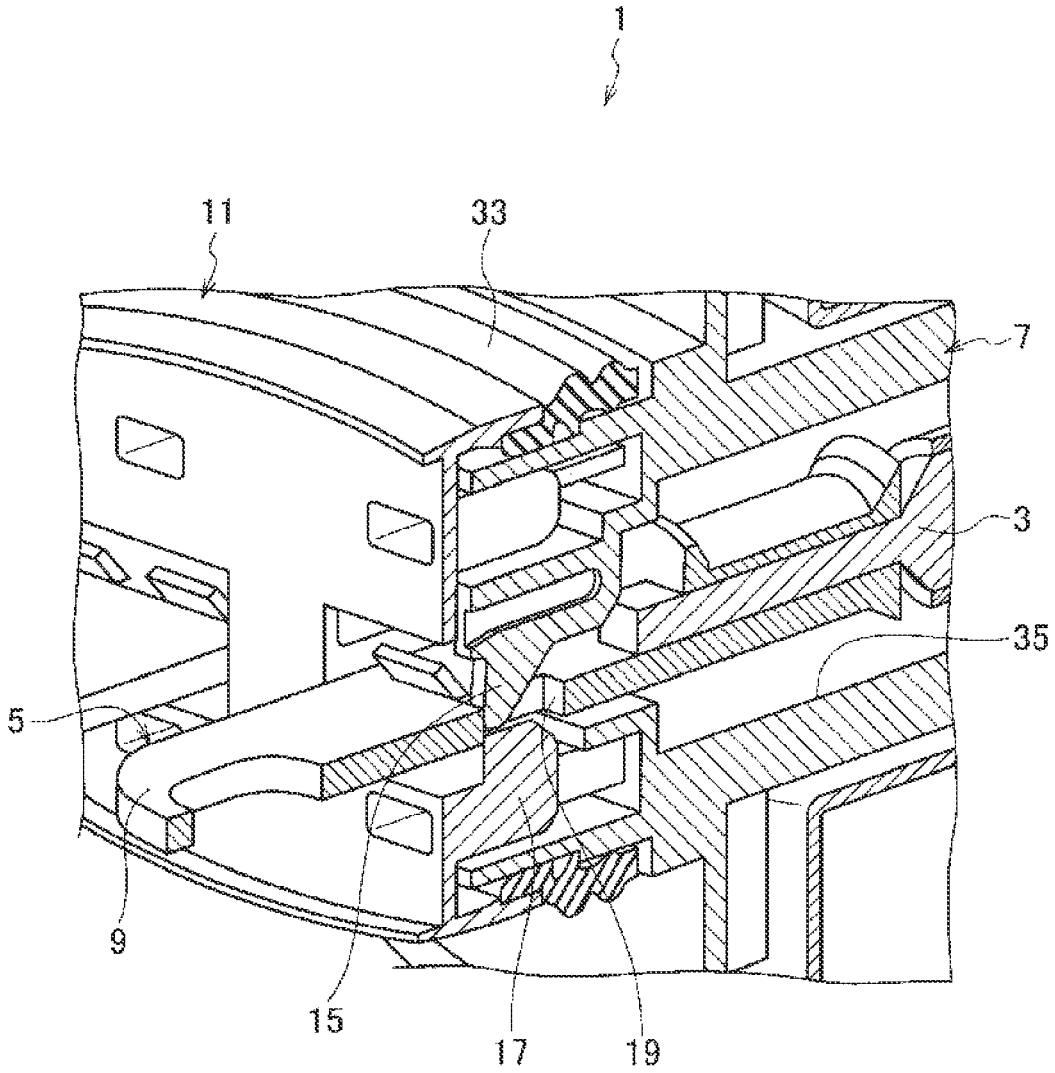
FIG. 3 is an enlarged perspective view of a main part of the connector according to the embodiment of the present invention.
Figure 4:
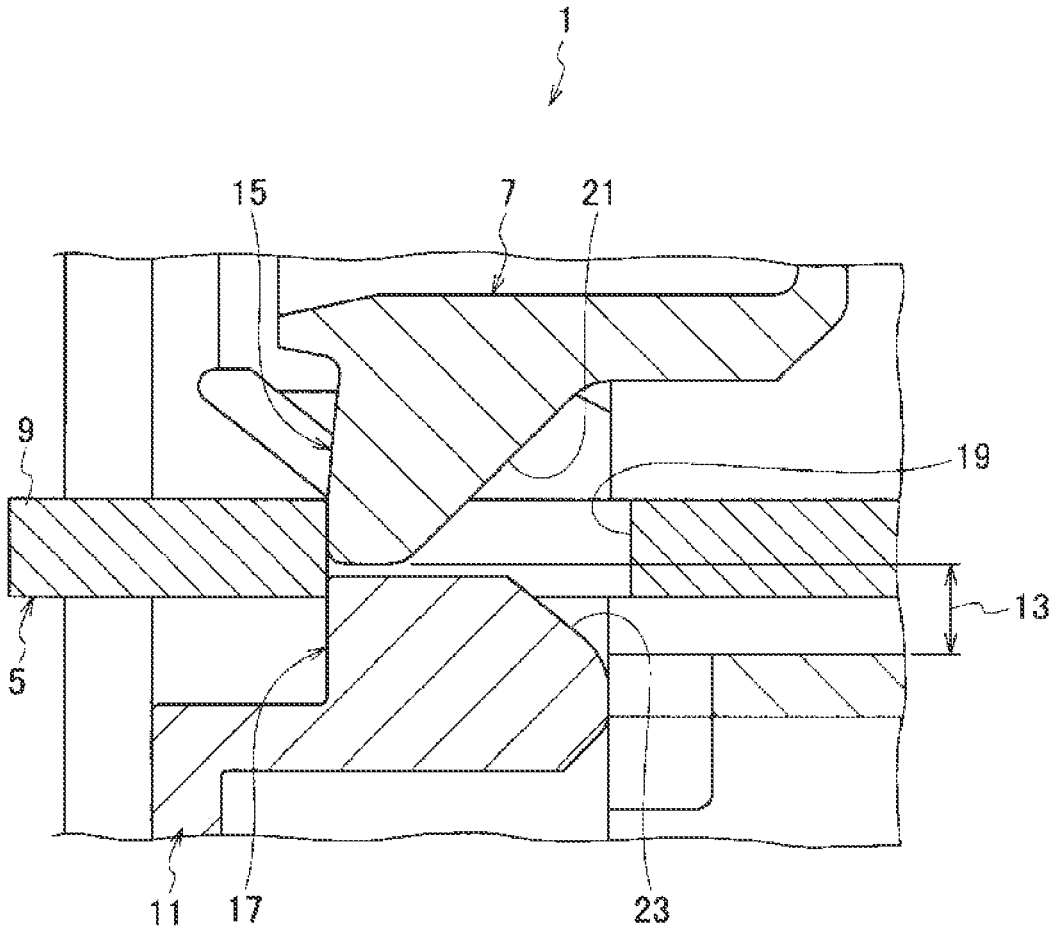
FIG. 4 is an enlarged perspective view of a main part of the connector according to the embodiment of the present invention.

Hereinafter, a connector according to an embodiment of the present invention will be explained with reference to FIG. 1 to FIG. 4.

A connector 1 according to the present embodiment includes a housing 7 that houses terminals 5 connected to electric wires 3, and a front holder 11 attached to the housing 7 to hold the terminals 5 in a regular position in a manner such that connecting portions 9 of the terminals 5 are exposed on the outside of the housing 7, and thereby prevent the terminals 5 from coming off the housing 7.

The housing 7 is provided with housing locking projections 15 provided in the housing 7 with insertion spaces 13 through which the terminals 5 can be inserted in the housing 7. The housing locking projections 15 lock and prevent the terminals 5 from coming off the housing 7 toward the electric wire 3 in the state in which the front holder 11 is attached to the housing 7.

The front holder 11 is provided with holder locking projections 17 in a manner as to be opposed to the housing locking projections 15 in the direction perpendicular to the extending direction of the terminals 5. The holder locking projections 17 are inserted in the insertion spaces 13 when the front holder 11 is attached to the housing 7 in the state in which the terminals 5 are housed in the housing 7. The holder locking projections 17 lock and prevent the terminals 5 from coming off the housing 7 in the state in which the front holder 11 is attached to the housing 7.

The housing locking projections 15 and the holder locking projections 17 are located in the same position in the extending direction of the terminals 5, and engage with common engaging holes 19 provided in the terminals 5.

The housing locking projections 15 are provided with terminal guiding portions 21 for guiding the terminals 5 to the insertion spaces 13. The holder locking projections 17 are provided with holder guiding portions 23 for guiding the holder locking projections 17 to the insertion spaces 13.

As shown in FIG. 1 to FIG. 4, the connector 1 includes the terminals 5 connected to the electric wires 3, the housing 7, a shell 25, a shield ring 27, waterproof members 29, a rear holder 31, a packing 33, and a front holder 11.

The terminals 5 are terminal metal fittings which are electrically connected, by press-fastening, to end portions of the plural (two in this embodiment) electric wires 3 connected to other members such as loads. The terminals 5 are connected to a high energy circuit housed in the casing (not shown in the figures). The terminals 5 are housed in the housing 7.

The housing 7 is made of insulating resin and formed into a cylindrical shape, and includes a terminal housing portion 35 for housing the terminals 5 therein, and a wire leading portion 37 communicated with the terminal housing portion 35 and leading the electric wires 3 therein. The housing 7 is fitted in the casing on the terminal housing portion 35 side so that the terminals 5 are connected to the high energy circuit. The housing 7 with such a configuration is provided with the shell 25 attached on the wire leading portion 37 side.

The shell 25 is made of a shield material for preventing entrance or leaking of noise and the like, and is attached to the periphery of the housing 7 on the wire leading portion 37 side. The shell 25 is press-fastened with the shield ring 27 together with a braided wire (not shown in the figures).

The shield ring 27 is made of a conductive material. The shield ring 27 is provided on the periphery of the shell 25 to press-fasten the braided wire and the shell 25 together so as to form a shield circuit. The waterproof members 29 are provided inside of the wire leading portion 37 of the housing 7 to which the shield ring 27 is attached.

The waterproof members 29 are formed into a rubber plug, and are provided inside of the wire leading portion 37 of the housing 7 in a manner such that inner circumferences of the waterproof members 29 are in close contact with outer circumferences of the electric wires 3. Outer circumferences of the waterproof members 29 come into close contact with the inner surface of the wire leading portion 37 of the housing 7 and seal the gap between the housing 7 and the electric wires 3 so as to define the inside and the outside of the housing 7. The waterproof members 29 are prevented from coming off the housing 7 due to the rear holder 31 attached to the opening of the wire leading portion 37 of the housing 7.

The rear holder 31 is made of insulating resin, and is composed of a pair of separated members 39, 41 formed into a semi-elliptical shape. The pair of separated members 39, 41 is provided on the rear side of the waterproof members 29 while interposing the electric wires 3 therebetween. The rear holder 31 is inserted in and seals the opening of the wire leading portion 37 of the housing 7 so as to prevent the waterproof members 29 from coming off the housing 7. The packing 33 is attached to the periphery of the terminal housing portion 35 of the housing 7, to which the rear holder 31 is attached.

The packing 33 is made of an elastic material such as rubber, and is tightly attached to the periphery of the terminal housing portion 35 of the housing 7. The packing 33 seals the gap between the housing 7 and the casing so as to separate the inside from the outside, respectively, in the state in which the housing 7 is fitted in the casing. The front holder 11 is attached to the opening of the terminal housing portion 35 of the housing 7 to which the packing 33 is attached, so as to prevent the packing 33 from coming off the housing 7.

The front holder 11 is made of insulating resin and formed into an elliptical lid shape. The front holder 11, through which the connecting portions 9 of the terminals 5 pass, is attached to the housing 7 in a manner as to cover the opening of the terminal housing portion 35 of the housing 7. The front holder 11 is attached to the housing 7 to hold the terminals 5 in a regular position in the terminal housing portion 35, and thereby prevent the terminals 5 from coming off the housing 7.

The terminals 5, which are prevented from coming off the housing 7 due to the front holder 11, are locked with the housing locking projections 15 and the holder locking projections 17, and are prevented from coming off the housing 7 on the wire leading portion 37 side.

The respective housing locking projections 15 are formed by a single member continuously projecting inward from the inner wall of the terminal housing portion 35 of the housing 7. The housing locking projections 15 are thus formed not to be flexible but to be rigid. The housing locking projections 15 are provided, on the front side, with the insertion spaces 13 through which the terminals 5 can be inserted from the wire leading portion 37 side. The connecting portions 9 of the terminals 5 are placed in the insertion spaces 13 in the state in which the terminals 5 are inserted in the terminal housing portion 35 before the front holder 11 is attached to the housing 7 since the housing locking projections 15 are not bent. The housing locking projections 15 are provided, on the wire leading portion 37 side (toward the right in FIG. 4), with the terminal guiding portions 21 inclined downward and toward the terminal housing portion 35. The terminal guiding portions 21 come into contact with tips of the terminals 5 and guide the terminals 5 to the insertion spaces 13 at the point of housing the terminals 5 from the wire leading portion 37 side.

The terminals 5 move toward the housing locking projections 15 when the front holder 11 is attached to the housing 7, so that the terminals 5 are located in a regular position. The housing locking projections 15 then engage with the engaging holes 19 provided in the connecting portions 9 of the terminals 5 and thereby lock the terminals 5. The lock of the terminals 5 with the housing locking projections 15 prevent the terminals 5 from coming off the housing 7 on the wire leading portion 37 side. The holder locking projections 17 are provided to face the housing locking projections 15 in the direction perpendicular to the extending direction of the terminals 5.

The respective holder locking projections 17 are formed by a single member continuously projecting toward the inside of the terminal housing portion 35 from the inner wall of the front holder 11 in a manner as to be located in the same position with respect to the housing locking projections 15 in the extending direction of the terminals 5. The holder locking projections 17 are thus formed not to be flexible but to be rigid. The holder locking projections 17 are provided, on the wire leading portion 37 side (toward the right in FIG. 4), with the holder guiding portions 23 inclined upward and toward the terminal housing portion 35. The holder guiding portions 23 come into contact with the tips of the terminals 5, and thereby move the terminals 5 toward the housing locking projections 15 and guide the holder locking projections 17 to the insertion spaces 13 when the front holder 11 is attached to the housing 7 in the state in which the terminals 5 are housed in the housing 7.

The holder locking projections 17 enter the insertion spaces 13 in association with the movement of the terminals 5 by the holder guiding portions 23 when the front holder 11 is attached to the housing 7 while the terminals 5 are housed in the housing 7. The holder locking projections 17 then engage with the engaging holes 19 of the terminals 5 and thereby lock the terminals 5. Thus, the terminals 5 are doubly locked with the holder locking projections 17 in addition to the lock with the housing locking projections 15 and accordingly, the terminals 5 can be prevented from coming off the housing 7 on the wire leading portion 37 side more reliably.

The housing locking projections 15 have larger locking margins for the engaging holes 19 than the holder locking projections 17. However, in the case in which the size of the terminal housing portion 35 of the housing 7 is restricted and thus there is not enough space for the insertion spaces 13, the locking margins of the holder locking projections 17 may be identical to, or larger than those of the housing locking projections 15.

In the connector 1 as described above, the housing 7 is provided with the insertion spaces 13 through which the terminals 5 can be inserted in the housing 7. The housing 7 is also provided with the housing locking projections 15 that lock the terminals 5 and thereby prevent the terminals 5 from coming off the housing 7 on the electric wire 3 side in the state in which the front holder 11 is attached to the housing 7. Therefore, the housing locking projections 15 are not required to be flexible unlike lances and accordingly, the resistance of the housing locking projections 15 to the external force can be improved.

Thus, the connector 1 can significantly prevent damage to the housing locking projections 15 by the external force, and thereby improve the retention stability of the terminals 5 in the housing 7.

The terminals 5 are locked with the housing locking projections 15 and the holder locking projections 17. Therefore, the terminals 5 can surely be prevented from coming off the housing 7, so that the retention stability of the terminals 5 in the housing 7 can be further improved.

The housing locking projections 15 and the holder locking projections 17 are provided in a manner as to face each other in the direction perpendicular to the extending direction of the terminals 5. Therefore, even if the external force is applied to the terminals 5, at least one of the locking projections can lock the terminals 5.

The holder locking projections 17 are inserted in the insertion spaces 13 provided in the housing locking projections 15. Therefore, the holder locking projections 17 are not required to be flexible unlike lances and as a result, the resistance of the holder locking projections 17 to the external force can be improved.

The housing locking projections 15 and the holder locking projections 17 are located in the same position with each other in the extending direction of the terminals 5, and engage with the same engaging holes 19 provided in the terminals 5. Therefore, the engaging holes 19 of the terminals 5 can be commonly used, and the structure of the terminals 5 can be thus simplified.

The housing locking projections 15 are provided with the terminal guiding portions 21 for guiding the terminals 5 to the insertion spaces 13, and the holder locking projections 17 are provided with the holder guiding portions 23 for guiding the holder locking projections 17 to the insertion spaces 13. Therefore, the terminals 5 can be easily locked with the housing locking projections 15 and the holder locking projections 17 at the point of attachment of the terminals 5 and the front holder 11 to the housing 7. Accordingly, the attachment performance can be improved.

The connector according to the embodiment of the present invention is provided with the holder locking projections in the front holder. However, the connector may be only provided with the housing locking projections as long as the terminals can be appropriately locked only with the housing locking projections.

Although the housing locking projections and the holder locking projections engage with the common engaging holes provided in the terminals, the housing locking projections and the holder locking projections may engage with different engaging holes, respectively.

Although the present invention has been described above by reference to the embodiments and the example, the present invention is not limited to those, and it will be apparent to these skilled in the art that various modifications and improvements can be made.

The entire content of Japanese Patent Application No. 2012-112289, filed on May 16, 2012, is herein incorporated by reference.

The invention claimed is:

1. A connector comprising:

a housing for housing a terminal connected to an electric wire; and a front holder attached to the housing, and configured to allow a connecting portion of the terminal to be exposed outside of the housing and hold the terminal in a regular position to prevent the terminal from coming off the housing, wherein the housing comprises a housing locking projection provided in the housing with an insertion space to allow the terminal to be inserted in the housing and configured to lock the terminal with the front holder attached to the housing to prevent the terminal from coming off the housing toward the electric wire, wherein the front holder comprises a holder locking projection located in a position opposed to the housing locking projection in a direction perpendicular to an extending direction of the electric wire, the holder locking projection being configured to be inserted in the insertion space when the front holder is attached to the housing with the terminal housed in the housing, and configured to engage and lock the terminal with the front holder attached to the housing to prevent the terminal from coming off the housing toward the electric wire, and wherein the housing locking projection and the holder locking projection are provided to be located in a same position in the extending direction of the electric wire and configured to engage with an engaging hole provided in the terminal.

2. The connector according to claim 1, wherein the housing locking projection comprises a terminal guiding portion configured to guide the terminal to the insertion space, and wherein the holder locking projection comprises a holder guiding portion configured to guide the holder locking projection to the insertion space.

* * * * *